US010864769B2

(12) United States Patent
Israelian

(10) Patent No.: US 10,864,769 B2
(45) Date of Patent: Dec. 15, 2020

(54) PAINTING METHOD AND COMPONENTS

(71) Applicant: Hratch Israelian, Whittier, CA (US)

(72) Inventor: Hratch Israelian, Whittier, CA (US)

( * ) Notice: Subject to any disclaimer, the term of this patent is extended or adjusted under 35 U.S.C. 154(b) by 211 days.

(21) Appl. No.: 15/893,348

(22) Filed: Feb. 9, 2018

(65) Prior Publication Data

US 2019/0248174 A1 Aug. 15, 2019

(51) Int. Cl.

| | |
|---|---|
| ***B44D 2/00*** | (2006.01) |
| ***B05D 1/36*** | (2006.01) |
| ***B05D 3/12*** | (2006.01) |
| ***B05D 5/06*** | (2006.01) |
| ***B44D 3/22*** | (2006.01) |

(52) U.S. Cl.

CPC ..... *B44D 3/22* (2013.01); *B05D 1/36* (2013.01); *B05D 3/12* (2013.01); *B05D 5/06* (2013.01); *B44D 2/00* (2013.01)

(58) Field of Classification Search

None

See application file for complete search history.

(56) References Cited

U.S. PATENT DOCUMENTS

| | | | | |
|---|---|---|---|---|
| 4,375,498 | A | 3/1983 | Le Minez et al. | |
| 4,578,131 | A | 3/1986 | Hawkins, Jr. | |
| 5,562,451 | A | 10/1996 | Wilcox et al. | |
| 5,635,251 | A | 6/1997 | Oda et al. | |
| 5,702,578 | A | 12/1997 | Umeda et al. | |
| 6,228,427 | B1 | 5/2001 | Wanger | |
| 6,663,143 | B2 | 12/2003 | Zirker | |
| 7,182,828 | B2 | 2/2007 | Zirker | |
| 7,629,400 | B2 | 12/2009 | Hyman | |
| 9,687,752 | B2 | 6/2017 | Clark et al. | |
| 9,713,938 | B2 | 7/2017 | Baker | |
| 2008/0194745 | A1* | 8/2008 | Cobb | C09D 5/06 524/186 |

OTHER PUBLICATIONS

JerrysArtarama, Using the Scrape and Reveal Technique with Bob Rankin, Youtube Video https://www.youtube.com/watch?v=6D0c6a95uJo; uploaded Dec. 31, 2013; Retrieved on Mar. 18, 2020 (Year: 2013).*

Clarke, J., Homemade edible finger paint recipe; https://www.kidspot.com.au/things-to-do/activity-articles/homemade-edible-finger-paint-recipe/news-story/b7de6ff8c52f58620ff1229e70eb9cf8 uploaded Nov. 3, 2013; Retrieved Mar. 19, 2020 (Year: 2013).*

* cited by examiner

*Primary Examiner* — Francisco W Tschen

(57) ABSTRACT

A painting method produces a realistic depiction of light areas, dark areas, an appearance of reflections, color gradation, textures, form and space, and an illusion of depth by overlapping the 1st, 2nd and 3rd planes. The image is created as all these formations emerge simultaneously. An oil or water coating and a corresponding oil or water base paint are prepared. A base having a glossy smooth surface is obtained. Both sides of the base are soaked and then any excess liquid is removed. The coating is applied over the wetted, glossy, smooth surface and a layer of paint is applied over the coating. Paint and coating merged into s single entity. A tool is then used to redistribute the mixture of paint and coating to create gradients of color to complete an image.

17 Claims, 2 Drawing Sheets

PAINTING METHOD AND COMPONENTS

BACKGROUND OF THE INVENTION

The present invention relates to painting methods and in particular to a method of creating images using tools to distribute the mixture of paint and coating over a smooth surface.

Known painting methods use brushes and the like to apply paint to a surface. While the known methods are satisfactory for creating images, they do not allow an artist to use various tools to control a redistribution of paint while creating the image.

BRIEF SUMMARY OF THE INVENTION

The present invention addresses the above and other needs by providing a painting method which produces realistic depictions of light areas, dark areas, an appearance of reflections, color gradation, textures, form and space, and an illusion of depth by overlapping the 1st, 2nd and 3rd planes. The image is created by a hand tool as the depictions emerge simultaneously. An oil or water base coating and a corresponding oil or water base paint are prepared. A base having a glossy smooth surface is obtained. Both sides of the base are soaked and then any excess liquid is removed. The coating is applied over the wetted, glossy, smooth surface and a layer of paint is applied over the coating. The paint and the coating merge into a single mixture. A tool is then used to redistribute the mixture of paint and coating to create gradients of color to complete an image.

In accordance with an aspect of the invention, there is provided a painting method altering the conformity of the paint, the tools and the means of their application, and the condition and the future of the surface on which the paint applied. These alterations provide the conditions necessary for the painting method to be fast and easy in oil-base and in water-based mediums.

In accordance with another aspect of the invention, there is provided a painting method providing a controllable liquid substance which can be molded into flat images on two dimensional surfaces of the paintings. The molding can take place when paint is diluted into a thin layer of creamy liquid that does not deform after it's distributed on a preferably white, smooth and horizontally residing surface of the base. Prior to the paint application, the entire surface must be evenly coated. The coating temporarily prevents or reduces stickiness between the paint and the surface, allowing the malleable paint to be manipulated by an artist using tools. The paint and coating mixture, and the horizontal smooth surface of the painting are required using both the oil-base and water-based materials, applied using two separate but similar processes of the method.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
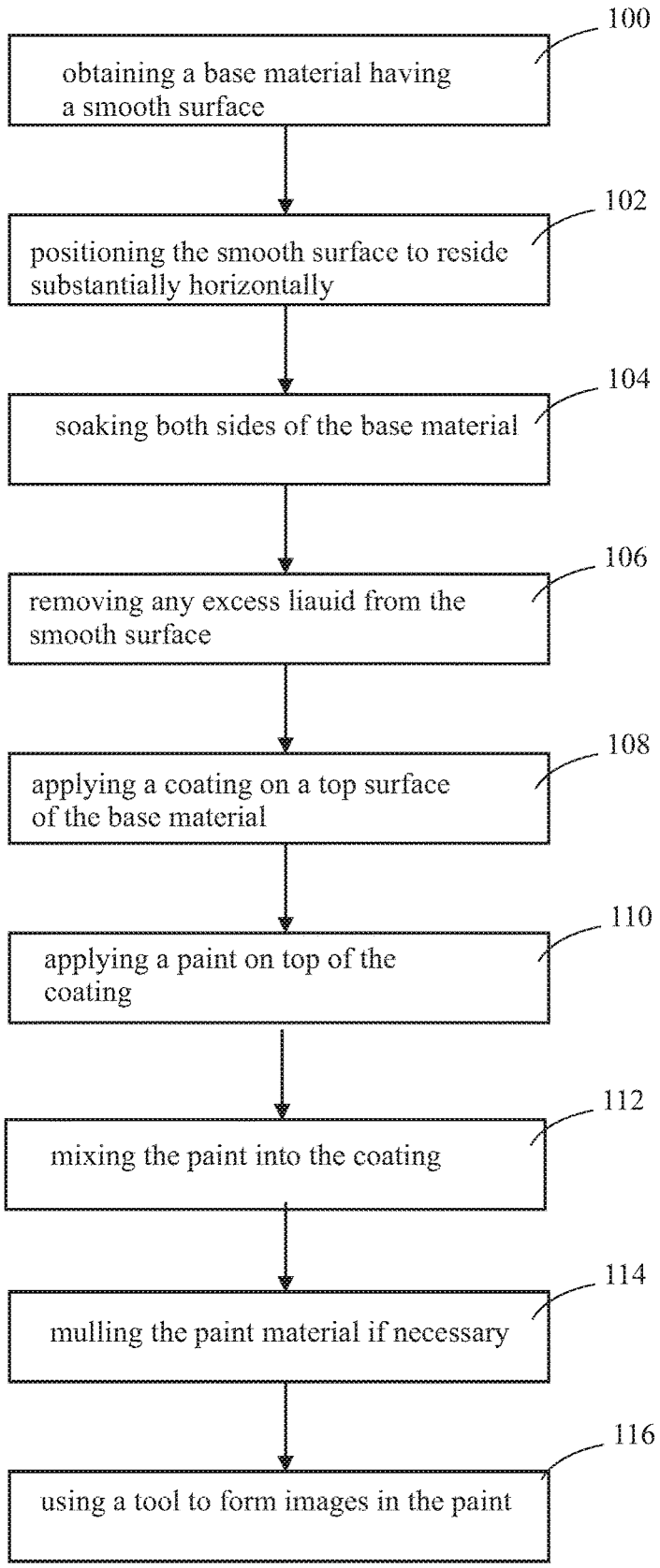
FIG. 1 is a method according to the present invention.

A painting method according to the present invention is shown in FIG. 1. A base material having at least one glossy smooth surface is obtained at step 100. For example, the base material may be plastic, metal, coated paper, cement, glass, solid transparent resinous material sold under the trade name Plexiglas, acrylic, ceramic, coated wood, or the like. The base material is positioned to reside substantially horizontally at step 102. The base material need not reside exactly horizontally as long as material disposed on the surface does not flow due to a sloping of the surface. Generally, the glossy smooth surface of the base material is white but for some projects the glossy smooth surface may be transparent or have a different color. The glossy smooth surface made of absorbent materials like paper and leather are soaked from both sides to prevent early drying at step 104. For water-based medium, both sides of the paper need to be saturated with water first. Remove any excess water from the glossy smooth surface at step 106.

A thin layer of coating material and water is applied to the glossy smooth surface of the base material at step 108. When applying the oil-based coating and paint, a thin layer of the coating may be applied to both sides of absorbent base materials when necessary. For non-absorbent materials, the coating need only be applied to the glossy smooth surface. After the water-base coating is applied on the glossy smooth surface, it may be diluted by adding water.

Before applying the paint material on top of the coating at step 110 and mixing the paint and coating to form a mixed paint and coating at step 112, mulling may be required elsewhere to disburse solid pigment material in the paint material to produce the desired colors. The paint later dissolves into the coating creating an even layer of cream like liquid on the glossy smooth surface at step 112 and may require an additional coating which is added and then rubbed by hands. The transformation of paint material into the cream like liquid can be felt by rubbing fingers through thin protective gloves. Another option is to blend the paint and coating substance to a desired viscosity elsewhere and then apply to the glossy smooth surface. In one embodiment the pigment may be sprinkled on the surface of the coating and rubbed into the cream like liquid, but care should be exercised to avoid inhaling any hazardous material. Sprinkling pigment on the coating may also take longer and can create blemishes on the resulting painting. Additional layers of paint may then be added over the first layer of paint to obtain multi-color effects.

After applying a thin layer of paint evenly covering the entire surface at the right viscosity, images may be formed using different tools made by a variety of materials and objects at step 116. Various images can be created using tools, depending on the consistency of the paint.

Figure 2:
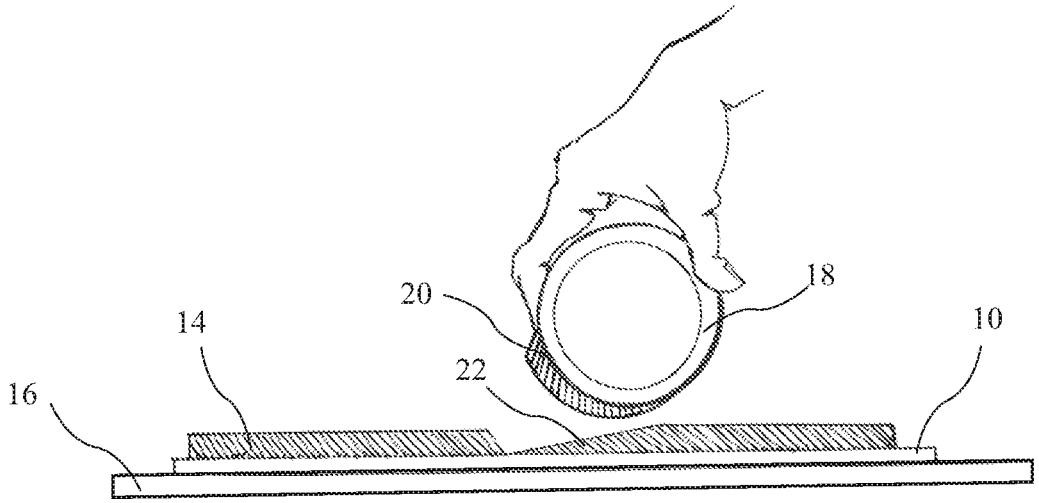
FIG. 2 shows creation of an image on flat base material according to the present invention.

FIG. 2 shows creation of images on a flat work surface 16 using a tool 18. The tool 18 touches the mixed paint and coating 14 using different combinations of sliding, pressing, and vibrating. The mixed paint and coating 14 may further be pressed between two smooth non-absorbent surfaces, to form into a varying gradient layer 22 of the mixed paint and coating 14, producing a smooth gradient of color, after the tool 18 is separated from the mixed paint and coating 14. The gradient effect is preferably created when the mixed paint and coating 14 is evenly distributed on the base 10. A simple movement of the tool 18 can develop realistic patterns, light and dark, color gradient, overlapping and depth. The layer of mixed paint and coating 14 is preferably thin and even on the base 10 and the tool 18 is preferably kept clean to lift mixed paint and coating 14 evenly from the base 10 creating a uniform gradient effect.

After a portion 20 of the mixed paint and coating 14 is transferred from the base 10 to the tool 18, the tool 18 is cleaned to be ready for a next step. While the tool 18 is picking up or spreading the mixed paint and coating 14, the base 10 may be partially or fully exposed through a smooth gradient. The whiteness of the base 10 is the lightest aspect in this painting process, and the smooth gradient of the color-shade from light to dark is an exact replication of the real light and its aptitude of spreading on the real object.

The tool 18 may be made from a flexible material and such flexible tool allows greater variations in images than a rigid tool. For example, a soft and dense foam or sponge material in water-based medium may be used to blend uneven and unattractive paint layers. Being an absorbent tool, the sponge can pick up and apply paint evenly. The tool 18 may also be a sheet plastic material, used with both water-based and oil-based mediums. The sheet plastic tool has the ability to be rolled, folded, and bent in order to create several different shapes providing different images.

Figure 3:
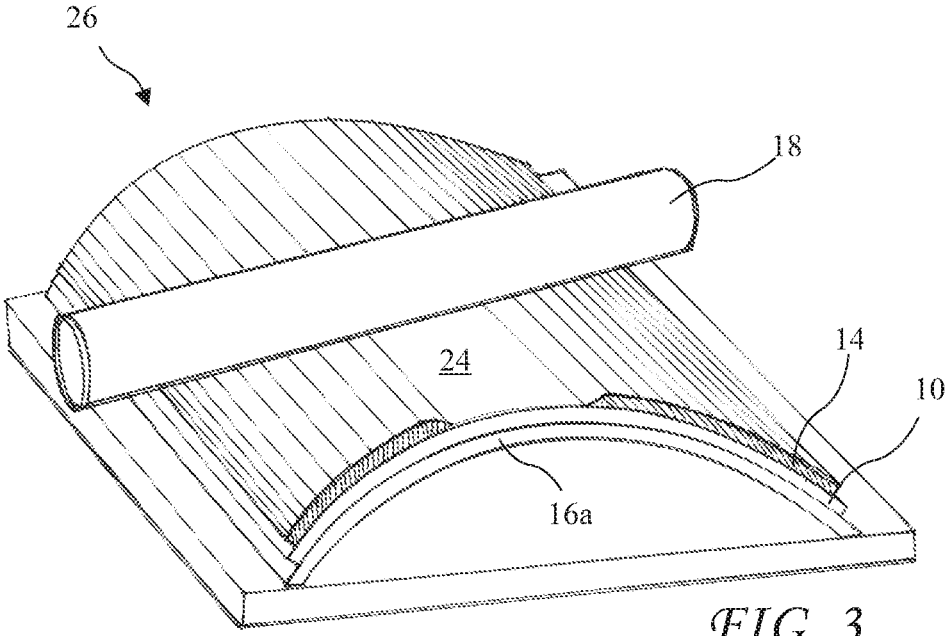
FIG. 3 shows creation of an image on arced base material according to the present invention.

FIG. 3 shows creation of an image 26 on an arced base material 10 resting on a arced work surface 16*a*. The arced base material 10 allows control of a contact area 24 of the mixed paint and coating 14 with the tool 18. For example, the lower parts of the arced base material 10 are not touched by the tool 18.

A broad variety of oils, solvents, and volatile petroleum distillation products can be used as a coating for an oil-based medium. However, a preferred coating is a mixture of oil and solvent. The ratio of this mixture can be very wide depending on the project. More oil makes the mixture thicker, and more solvent makes the mixture thinner. Examples of oils which may be used are: vegetable oil; sunflower oil; flaxseed (linseed) oil; canola oil; walnut oil; soy oil; and the like. Examples of solvents which may be used are: diluent reducer; d-limonene; citrus solvent; acetone; and the like. Kerosene for example with or without transparent white VS309, may also be used to make the paint and the coating, but may present health issues. The above mentioned oils and solvents have priority mainly for health safety reasons. Any one of these oils can be mixed with one of the four solvents to serve as coating and the same mixture of solvent and oil may be used to dilute the color pigment to a desired consistency.

Many types of white powder material obtained from a variety of food products like flours and starches of wheat, potatoes, rice, corn and other equivalents may be used as the main element of a coating for a water based medium. The white powder material is boiled in water to become a gluey loose pudding. The boiling can be done through conventional methods. The water-based coating is now essentially ready. However, this Coating can also have non-essential additions. For example, alum or gum-arabic can be added approximately 1 to 6 present of the main powder. There are other substances that can serve as coating with a very slight esthetic compromise. One of them is clear wall covering adhesive. After the coating was applied on the surface of the painting it must be diluted by adding water.

While preferred ingredients are described above, those skilled in the art will recognize suitable alternative ingredients, and the water-based and oil-based coating made from these alternative ingredients are intended to come within the scope of the present invention.

The ingredients used to prepare the coating may also be used in preparation of paint for both oil-base and water-based mediums, and in some instances the paint may be directly applied to smooth surface not having a coating. This will work if the paint is diluted and surface becomes saturated with the excessive amount of paint. However, this approach may be problematic for the following stages of the painting.

An oil-base paint is prepared by mixing of the oil-based coating and a color pigment in approximately equal amounts. Since each color pigment has a deferent chemical composition, some color pigments require less coating than others, in order to match the density of the oil-based paint to a commonly used paint. This matching is only for easy mulling, and the single purpose of the mulling is to crush pigment particles in the color pigment. The mulled paint is dissolved into a creamy liquid later, at the time of painting, with a ratio that is appropriate to the particular project.

A water-base paint is prepared by mixing the water-based coating and color pigments in approximately equal amounts. A small amount of an additional third ingredient is included to dissolve the pigments. The third ingredient may be, for example, polyethylene glycol, propylene glycol or glycerin or other equivalent ingredients. The amount of the third ingredient varies based on the type of pigments used and the projects. The water-base paint may also required mulling to crush pigment particles.

While the invention herein disclosed has been described by means of specific embodiments and applications thereof, numerous modifications and variations could be made thereto by those skilled in the art without departing from the scope of the invention set forth in the claims.

I claim:

1. A painting method for creating artistic images that produces simultaneous realistic depiction of light areas, dark areas, appearance of reflections, color gradations, textures, form and space, and illusion of depth; the method comprising:

a) obtaining a base material having at least one glossy smooth surface;

b) positioning the base material substantially horizontally such that a water-based coating and a paint disposed on the surface of the base material does not flow;

c) applying the water-based coating to the glossy smooth surface of the base material, the water-based coating comprising a white powder selected from flours and starches of wheat, potatoes, rice, and corn, the water-based coating having been boiled with water to become gluey pudding;

d) optionally diluting the water-based coating on the glossy smooth surface with water;

e) applying the paint over the water-based coating, the paint dissolving into the water-based coating and creating a cream-like single mixture, wherein the paint comprises approximately equal parts of the water-based coating and color pigments, and the paint further comprising a third ingredient selected from the group consisting of polyethylene glycol, propylene glycol or glycerin; and f) using a tool to form images in the cream-like single mixture, wherein using the tool comprises pressing the tool into the cream-like single mixture on the base material, the tool picking up or spreading the cream-like single mixture such as to partially or fully expose the base material, and the lightest aspect of the artistic image created being the base material whiteness.

2. The method of claim 1, wherein the water-based coating comprises alum or gum-arabic.

3. The method of claim 1, wherein the tool is selected from a variety of objects and materials based on the consistency of the paint.

4. The method of claim 1, wherein using the tool further comprises moving the tool to create patterns of light and dark, color gradient, overlapping and depth.

5. The method of claim 1, wherein the tool picking up the cream-like single mixture transfers the cream-like single mixture from the base to the tool, and the tool is cleaned to be ready for a next step.

6. The method of claim 1, wherein the base material is selected from the group consisting of plastic, metal, coated paper, cement, glass, poly(methylmethacrylate) (PMMA), acrylic, ceramic, coated wood, and leather.

7. The method of claim 6, wherein when an absorbent base material such as paper or leather are selected, both sides of the absorbent base material are saturated with water to prevent early drying.

8. The method of claim 7, wherein any excess water after saturation of the absorbent base material is removed.

9. The method of claim 1, wherein the color pigments of the paint are mulled to disburse solid pigment material in the paint and produce the desired colors.

10. The method of claim 1, wherein after applying the water-based coating, pigment is sprinkled on the surface of the water-based coating.

11. A painting method for creating artistic images that produces simultaneous realistic depiction of light areas, dark areas, appearance of reflections, color gradations, textures, form and space, and illusion of depth; the method comprising:

a) obtaining a base material having at least one glossy smooth surface;

b) positioning the base material substantially horizontally such that an oil-based coating and a paint disposed on the surface of the base material does not flow;

c) applying the oil-based coating to the glossy smooth surface of the base material, the oil-based coating comprising an oil and a solvent; and wherein the oil is selected from the group consisting of vegetable oil, sunflower oil, flaxseed oil, canola oil, walnut oil, and soy oil; and the solvent is selected from the group consisting of d-limonene, citrus solvent, acetone, diluent reducer, and kerosene;

d) applying the paint over the oil-based coating, the paint dissolving into the oil-based coating and creating a cream-like single mixture, wherein the paint comprises approximately equal parts of the oil-based coating and color pigments; and e) using a tool to form images in the cream-like single mixture, wherein using the tool comprises pressing the tool into the cream-like single mixture on the base material, the tool picking up or spreading the cream-like single mixture such as to partially or fully expose the base material, and the lightest aspect of the artistic image created being the base material whiteness.

12. The method of claim 11, wherein the tool is selected from a variety of objects and materials based on the consistency of the paint.

13. The method of claim 11, wherein using the tool further comprises moving the tool to create patterns of light and dark, color gradient, overlapping and depth.

14. The method of claim 11, wherein the tool picking up the single mixture transfers the single mixture from the base to the tool, and the tool is cleaned to be ready for a next step.

15. The method of claim 11, wherein the base material is selected from the group consisting of plastic, metal, coated paper, cement, glass, poly(methylmethacrylate) (PMMA), acrylic, ceramic, coated wood, and leather.

16. The method of claim 15, wherein when an absorbent base material is selected, a thin layer of the oil-based coating material is applied to both sides of the absorbent material.

17. The method of claim 11, wherein the color pigments of the paint are mulled to disburse solid pigment material in the paint and produce the desired colors.

* * * * *